United States Patent [19]

Folgerö et al.

[11] 3,967,955

[45] July 6, 1976

[54] METHOD FOR TREATING A METAL MELT

[75] Inventors: Käre M. Folgerö; Bengt Fredriksson, both of Vasteras; Lars-Gunnar Norberg, Hagfors; Karl-Erik Öberg, Borlange, all of Sweden

[73] Assignee: Uddeholms Aktiebolag, Hagfors, Sweden

[22] Filed: Apr. 15, 1975

[21] Appl. No.: 568,159

[30] Foreign Application Priority Data

Apr. 16, 1974 Sweden ..... 74.05030

[52] U.S. Cl. ..... 75/12; 75/53

[51] Int. Cl.[2] ..... C21C 5/52

[58] Field of Search ..... 75/10–12, 75/53–60

[56] References Cited

UNITED STATES PATENTS

| | | | |
|---|---|---|---|
| 3,413,113 | 11/1968 | Vogels | 75/12 |
| 3,523,785 | 8/1970 | Gero | 75/12 |
| 3,708,599 | 1/1973 | Krause | 75/60 |
| 3,771,998 | 11/1973 | Knuppel | 75/60 |
| 3,827,877 | 8/1974 | Pantke | 75/12 |

*Primary Examiner*—Peter D. Rosenberg
*Attorney, Agent, or Firm*—Cushman, Darby & Cushman

[57] ABSTRACT

A method of treating molten metal in a converter having an induction heater the heating space of which opens into the lowermost portion of the converter compartment comprises injecting a mixture of a solid treating material in powder form with a carrier gas through a sidewall of the converter at a level only slightly above the bottom wall of the converter compartment. A tuyère through which the gas-powder mixture is injected is directed slightly downward and toward the region where the heating space of the induction heater opens into the converter compartment.

7 Claims, 3 Drawing Figures

METHOD FOR TREATING A METAL MELT

This invention relates to the treatment of molten metal in a reaction vessel of the type having a refractory lining and heating means in the form of at least one induction-heated space opening into the lower portion of the vessel. More particularly, the invention relates to a method of treating a bath of molten metal in a reaction vessel of the just-mentioned type, which method comprises injecting a fluid into the bath of molten metal below the surface thereof. The treatment may involve, for example, decarburization of pig iron or refining of steel.

In operations including injection of fluids through a tuyère into metallurgical reaction vessels, such as converters, the erosion of the lining in the region of the tuyère is a constant problem. This is true both with regard to erosion of the bottom lining of converters in which the injection takes place from below and with regard to sidewall erosion in converters in which the injection takes place laterally. An object of the invention is to eliminate or at least substantially reduce this problem.

Another problem is the sidewall erosion caused by vigorous splashing or other movements of the surface of the bath. It is also an object of the invention to substantially reduce such splashing or movements and, accordingly, the erosion of the lining in the region of the bath surface.

To accomplish these objects a method is provided which comprises injecting a mixture of a carrier gas and a solid treating material in powder form into the bath of molten metal below the surface thereof, the mixture being injected into the bath through one or more tuyères in a direction within an angular range extending from about 15° above the horizontal to about 45° below the horizontal. The preferred direction of injection is in a range from 8° to 22' below the horizontal direction and toward a region of the reaction vessel where the induction-heated space or spaces are provided Other objects, features and advantages of the invention will be more fully understood from the following description considered in conjunction with the accompanying drawings, in which FIG. 1 is a vertical sectional view of a converter in which the method of the invention is realized;

Figure 1:
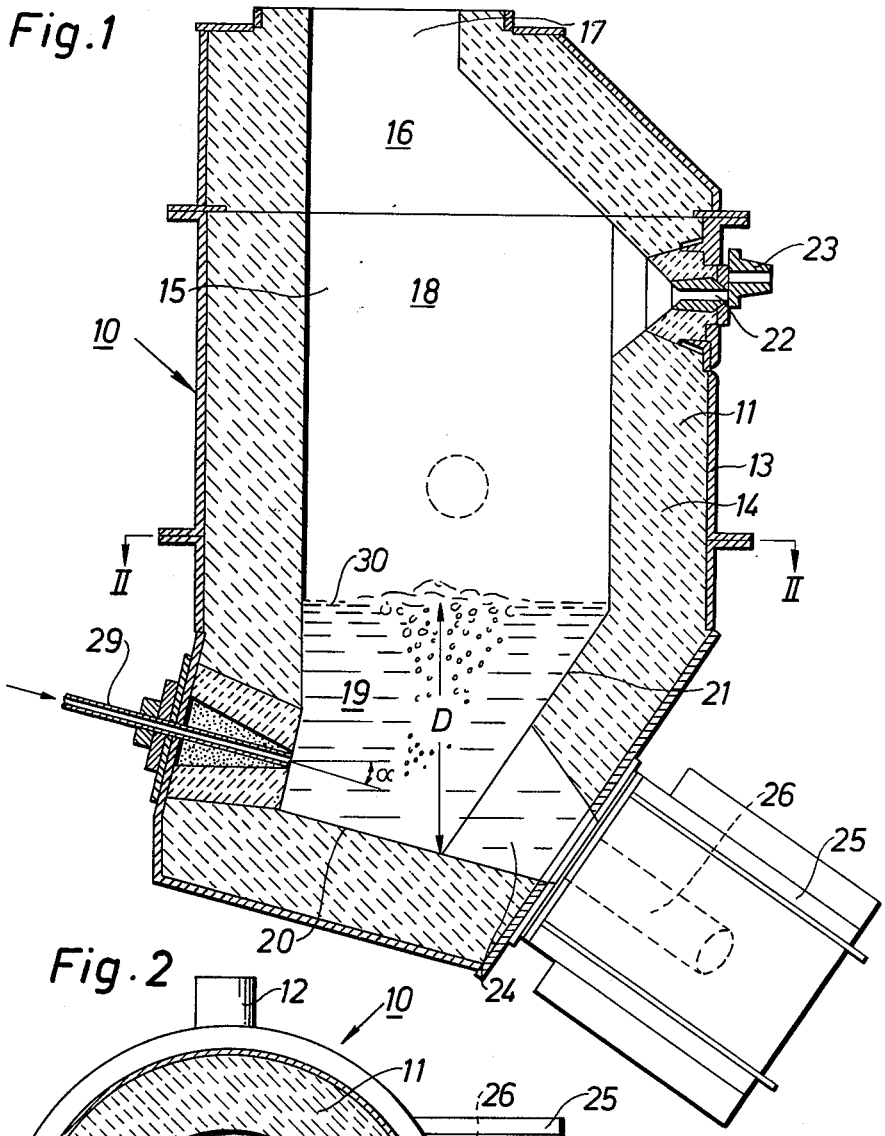
Figure 2:
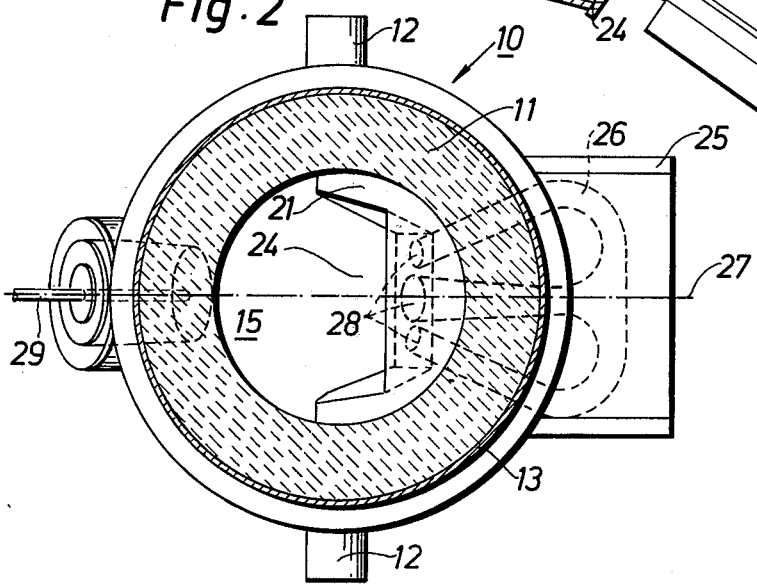
FIG. 2 is a horizontal sectional view on line II—II of FIG. 1.

The converter 10 shown in FIGS. 1 and 2 has a reaction vessel 11 mounted for tilting movements about a horizontal axis defined by a pair of trunnions 12. The converter vessel 11 has a steel shell 13 and is provided with a refractory lining 14. The compartment 15 defined by the lining comprises an upper portion 16 tapering upwardly to a charging opening 17, a generally cylindrical intermediate portion 18 and a lower portion 19 having an inclined flat bottom surface 20 and a likewise inclined flat sidewall section 21. As shown in FIG. 2, the remainder of the sidewall of the lower portion 19 is defined by an extension of the cylindrical inner surface of the intermediate portion 18.

Adjacent the upper end of the intermediate portion 18 a tapping hole 22 with a sliding gate 23 is provided through which the converter 10 may be tapped after it has been tilted to a horizontal or nearly horizontal position.

In the region of the lowermost portion of the flat sidewall section 21, that is, adjacent the flat bottom surface 20, a recess 24 is provided which extends through the lining 14 and the steel shell 13. Directly in connection to this recess an induction heater 25 of known construction is removably secured to the steel shell 13. The induction heater 25 includes an iron core (not shown), an induction winding (not shown), and an omega shaped heating channel or heating space 26 adapted in operation to contain molten metal to be heated. Depending on the type of treatment to be effected, the induction heater serves to supply the heat needed to maintain or raise the temperature of the molten metal in the converter compartment.

As shown in FIG. 2, the omega shaped heating space 26 is disposed symmetrically with respect to a vertical plane of symmetry 27 perpendicular to the tilting axis of the converter. The free ends 28 of the three limbs of the heating space 26 are in constant open communication with the recess 24 and, accordingly, with the lower portion 19 of the converter compartment 15. As best shown in FIG. 1, the induction heater 25 is mounted on the converter vessel 11 such that the heating space 26 is not emptied even if the converter vessel is tilted almost to the horizontal position during tapping.

Directly opposite to the recess 24 and the heating space 26 a tuyere 29 extends through the converter sidewall in the plane 27 of symmetry and opens into the lower portion 19 of the converter compartment 15 flush with the adjacent section of the sidewall. Although for convenience means for cooling the tuyere have not been shown, it is to be understood that a cooling jacket or any other suitable cooling means may be provided. As shown in FIG. 1, the tuyere opens into the lower portion 19 of the converter compartment 15 at a level slightly above the inclined bottom wall 20, that is, at a substantial depth below the surface 30 of the bath of molten metal to be treated in the converter compartment. This depth should preferably be at least equal to half the depth D of the bath which is herein defined as the vertical distance between the surface 30 of the bath and the lowermost portion of the converter compartment 15, to which the recess 24 and the heating space 26 do not belong.

In operation of the converter 10, a solid treating material in powder form is injected through the tuyère 29 into the bath of molten metal with a carrier gas which may be an inert or a non-inert gas. The treating material may be any of several substances, such as metal powder, lime powder, carbon powder, finely divided ore concentrate and mixtures of these and other powders.

As shown in FIG. 1, the tuyère 29 is slightly inclined downwardly when the converter vessel 11 is in the illustrated vertical treating position. The angle of inclination to the horizontal is designated $\alpha$ and, in the illustrated example, is about 15° to the horizontal plane. Depending on the dimensions and shape of the converter vessel 11 and the concentration and momentum of the injected powder, the angle of inclination may be varied within a range extending from 15° in the upward direction to 45° in the downward direction. A suitable range extends from the horizontal down to 30° in the downward direction, and for best results, an angle of inclination in the range of 8° to 22° in the downward direction should be chosen. The illustrated angle of 15° in the downward direction has been found to result in a very intimate mixing of the molten metal and the injected treating material without unduly disturbing the surface of the bath.

It is an important feature of the invention that the gas-powder mixture is injected through the sidewall of the converter toward a diametrically opposite location, namely, a location at or near the center of the region where the induction heater is located. In the illustrated example, the center of this region is defined by the central limb of the heating space 26. In the case of an induction heater having a U-shaped heating space, the center is defined by a point on the surface bridging the open ends of the two limbs. While only one tuyères is shown in the drawings, the injection may of course take place through two or more tuyères the axes of which converge toward a point at or near the center of the region where the heating space or the associated recess in the lining opens into the converter compartment.

Other factors having a strong influence on the flow pattern resulting from the injection are the concentration and momentum of the injected powder. The ideal flow pattern is produced when the momentum of the powder is just about sufficient to bring the jet of gas and powder to the region of the center of the converter vessel, then permitting the flow of injected material to deflect upwardly while spreading toward the periphery of the converter compartment 15 substantially without causing cascades or vigorous splashing at the surface of the bath. Therefore, according to the invention, the powder concentration and momentum are chosen within given limits, taking such factors as the dimensions of the vessel and the desired metallurgical reactions into consideration, and the angle of inclination, the concentration and the momentum are matched with each other such that the desired flow pattern is attained as closely as possible. Thus, the gas-powder mixture is caused to contain at least 5 kilograms, preferably at least 15 kilograms, of solid material in powder form per cubic meter (at normal temperature and pressure) of gas. Moreover, this mixture is injected through the tuyère 29 at such a velocity and at such a weight rate that the momentum of the powder corresponds to an injection of at least 0.03 kilogram of solid material per minute per square millimeter of interior cross-sectional area of the tuyère at the point where the tuyere opens into the converter compartment. More particularly, the momentum should correspond to at least 0.1, preferably at least 0.2 and suitably at least 0.3 kilogram of solid material per minute per square millimeter of tuyère area. At the same time, however, the momentum is limited such that it is insufficient to bring the powder into the heating space of the induction heater.

Figure 3:
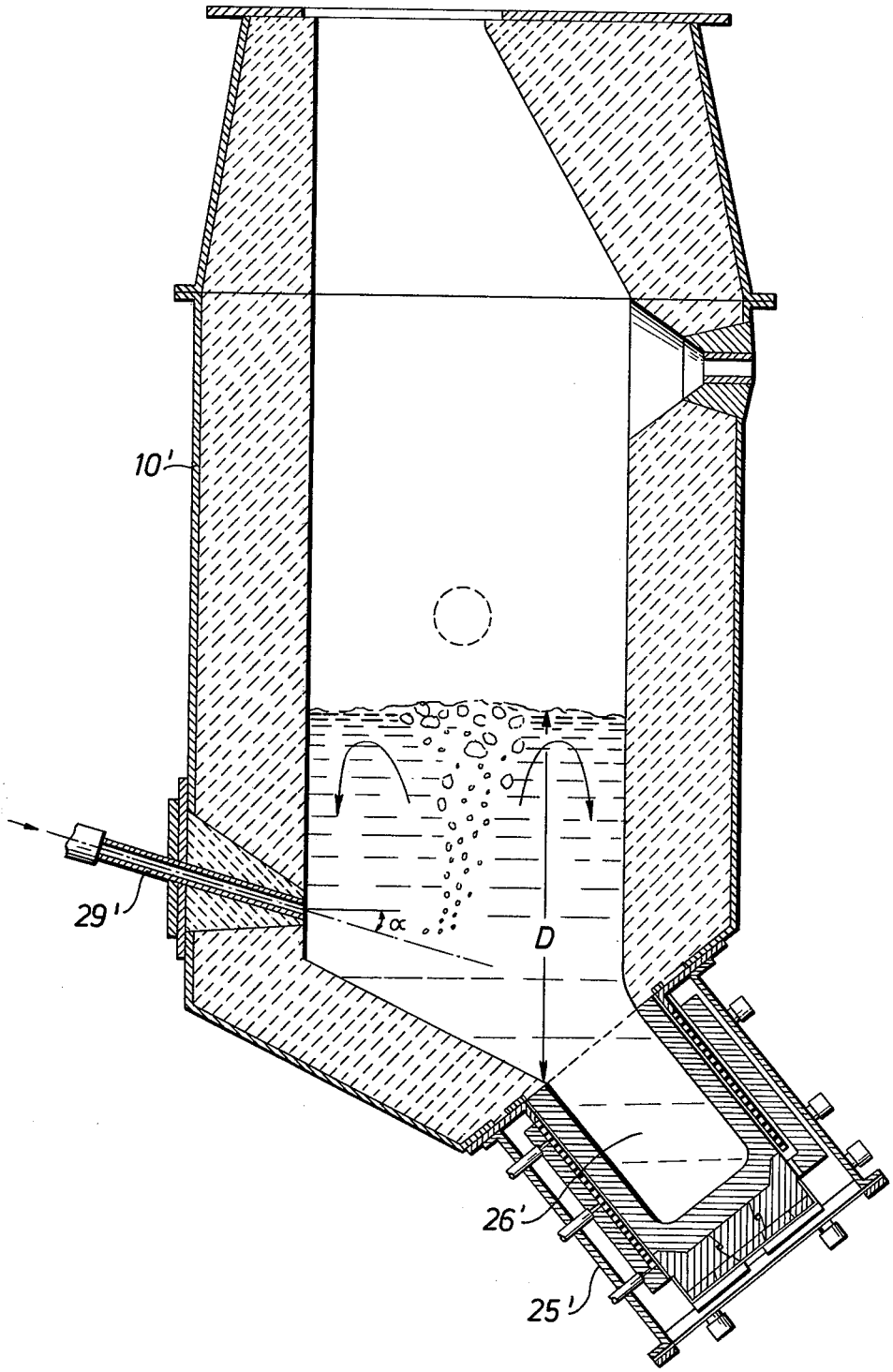
FIG. 3 is a sectional view similar to FIG. 1 and shows a modified converter in which the method of the invention is realized.

FIG. 3 shows a converter 10' with an induction heater 25' the heating space 26' of which is defined by a cylindrical crucible. A tuyère 29' is arranged in a manner entirely similar to that shown in FIGS. 1 and 2.

The injection of the gas-powder mixture through the tuyère 29' likewise takes place exactly as described above with reference to FIGS. 1 and 2.

The foregoing specific embodiments have been described for the purpose of illustrating the principles of the present invention, and the same is subject to modification without departure therefrom. Therefore, the invention includes all modifications encompassed within the spirit and scope of the appended claims.

What is claimed is:

1. A method for treating a bath of molten metal in a reaction vessel having a refractory lining and at least one induction-heated space opening into the lower portion of the reaction vessel, said method comprising the step of injecting into the bath a mixture of gas and a solid material in powder form, said mixture containing at least 5 kilograms of solid material per cubic meter, as measured at normal temperature and pressure, of gas, and being injected through a tuyère extending through the lining and opening into the bath below the surface thereof, the injection being made in a direction between 15° above and 45° below the horizontal direction and at such a velocity and at such a weight rate that the momentum of the solid material corresponds to an injection of at least 0.03 kilogram of solid material per minute per square millimeter of internal cross-sectional area of the tuyère.

2. A method as claimed in claim 1 in which the mixture of gas and solid material contains at least 15 kilograms of solid material per cubic meter, as measured at normal temperature and pressure, of gas.

3. A method as claimed in claim 1 in which the momentum of the injected solid material corresponds to injection of at least 0.1 kilogram of solid material per minute per square millimeter of internal cross-sectional area of the tuyère.

4. A method as claimed in claim 1 in which the momentum of the injected solid material corresponds to injection of at least 0.3 kilogram of solid material per minute per square millimeter of internal cross-sectional area of the tuyère.

5. A method claimed in claim 1 in which the mixture of gas and solid material is injected in a direction between the horizontal direction and 30° below the horizontal direction.

6. A method as claimed in claim 1 in which the mixture of gas and solid material is injected in a direction between 8° and 22° below the horizontal direction.

7. A method as claimed in claim 1 in which the mixture of gas and solid material is injected through a sidewall of the reaction vessel towards the center of the region in which the heating space opens into the lower portion of the reaction vessel, said injection taking place from a diametrically opposite region of said lower portion.

* * * * *